US007000801B2

(12) United States Patent
Rodriguez

(10) Patent No.: US 7,000,801 B2
(45) Date of Patent: Feb. 21, 2006

(54) COMBINATION ADJUSTABLE DIAMETER DRINKING VESSEL SLEEVE AND RECYCLABLE BEVERAGE COASTER

(76) Inventor: Albert Rodriguez, 2020 NW. 107th Ave., Pembroke Pines, FL (US) 33026

( * ) Notice: Subject to any disclaimer, the term of this patent is extended or adjusted under 35 U.S.C. 154(b) by 399 days.

(21) Appl. No.: 10/600,496

(22) Filed: Jun. 20, 2003

(65) Prior Publication Data

US 2004/0011801 A1 Jan. 22, 2004

Related U.S. Application Data

(60) Provisional application No. 60/389,670, filed on Jun. 20, 2002.

(51) Int. Cl.
*B65D 25/00* (2006.01)

(52) U.S. Cl. ..... 220/737; 220/739

(58) Field of Classification Search ..... 220/666, 220/680, 737, 738, 739, 903, 906; 229/89, 229/90, 101, 403
See application file for complete search history.

(56) References Cited

U.S. PATENT DOCUMENTS

| | | | | |
|---|---|---|---|---|
| 2,586,078 | A * | 2/1952 | O'Malley | 206/397 |
| 3,908,523 | A | 9/1975 | Shikaya | 93/36.01 |
| 4,685,583 | A * | 8/1987 | Noon | 220/710.5 |
| 5,102,036 | A * | 4/1992 | Orr et al. | 229/89 |
| 5,205,473 | A | 4/1993 | Coffin, Sr. | 229/1.5 B |
| 5,209,367 | A * | 5/1993 | Van Musscher et al. | 229/87.01 |
| 5,445,315 | A | 8/1995 | Shelby | 229/117.06 |
| 6,026,983 | A | 2/2000 | Graham | 220/738 |
| 6,273,333 | B1 | 8/2001 | Ward | 229/402 |
| 2002/0185496 | A1 * | 12/2002 | Puerini | 220/738 |

* cited by examiner

*Primary Examiner*—Stephen K. Cronin
*Assistant Examiner*—Harry Grosso
(74) *Attorney, Agent, or Firm*—Frank L. Kubler

(57) ABSTRACT

A drinking vessel sleeve includes a sleeve side wall sheet having a first side wall sheet end and a second side wall sheet end and being coiled into a tubular sleeve configuration having a sleeve circumference so that the first side wall sheet end is radially spaced inwardly from the second side wall sheet end, and including an adjustment lever structure pivotally interconnecting the first and second side wall sheet ends and extending radially inwardly from the first side wall sheet end to define a lever tab portion; so that pivoting the lever tab portion toward the first side wall sheet end increases the sleeve circumference to receive a larger diameter vessel, and pivoting the lever structure toward the second side wall causes the second side wall end to overlap the first side wall end to decrease the sleeve circumference to receive a smaller diameter vessel.

11 Claims, 5 Drawing Sheets

COMBINATION ADJUSTABLE DIAMETER DRINKING VESSEL SLEEVE AND RECYCLABLE BEVERAGE COASTER

FILING HISTORY

This application continues from provisional application No. 60/389,670 filed on Jun. 20, 2002.

BACKGROUND OF THE INVENTION

1. Field of the Invention

The present invention relates generally to the field of drinking vessel holders. More specifically the present invention relates to an adjustable diameter drinking vessel sleeve including a sleeve side wall sheet having first side wall sheet end and a second side wall sheet end and being coiled into a tubular configuration so that the first side wall sheet end is radially spaced inwardly from the second side wall sheet end, and including a substantially rigid or resilient adjustment lever structure pivotally interconnecting the first and second side wall sheet ends and extending radially inwardly from the first side wall sheet end to define a lever tab portion, so that pivoting the lever structure toward the first side wall sheet end circumferentially spaces the first and second ends apart from each other to place the sleeve in a larger diameter mode to receive larger diameter drinking vessels, and pivoting the lever structure toward the second side wall end causes the second side wall to overlap the first side wall end and thereby places sleeve in a smaller diameter mode to receive small diameter drinking vessels. A vessel within the sleeve laterally abuts the tab portion and thereby retains the tab portion in its pivoted position, in turn retaining the sleeve in its given diameter mode. The sleeve in its larger diameter mode preferably is sized in diameter to snugly receive a standard sized beverage can or soft drink bottle and in its smaller diameter mode preferably is sized in diameter to snugly receive a standard sized beer bottle. The sleeve preferably has diametrically opposed longitudinal, axial fold lines so that the empty sleeve can be folded flat and function as a coaster.

2. Description of the Prior Art

There have long been gripping sleeves for receiving and holding beverage vessels to help the user grip the vessel and to insulate the user hand from the discomfort of extremely hot or cold beverage temperatures. Many such vessel sleeves and vessel coasters are marketed today. Most are adorned with product or corporate logos. These products are usually given away as promotional items and are typically distributed at trade shows or festivals. They are typically constructed of polystyrene, closed or open cell foam, vinyl, plastic, or neoprene, and shaped into a cylindrical form into which a beverage vessel such as an aluminum can or glass bottle is inserted. Although these products are mass-produced, they are still relatively expensive when used in a promotional fashion. The insulating materials from which these sleeves are constructed are expensive, and can be difficult to print on. They may require the use of special coatings or processes to create the advertising indicia in the form of an image or message, which can significantly increase the cost of manufacturing the vessel sleeve.

Most of these sleeves are only deigned to fit one size of beverage vessel. When used with vessels of varying size, it may result in too loose a fit, and a subsequent reduction in insulating value, or too tight a fit, making removal and replacement of beverages difficult.

Because most vessel sleeves assume a permanent cylindrical shape when not in use, they utilize a large amount of storage space. This can be problematic, especially when a large quantity must be stored or shipped, and there is a limited amount of space.

Vessel sleeves of this nature are ubiquitous, and many are discarded, lost or disposed of after a short time. They can be seen littering our beaches and parks, and floating in our lakes, rivers and oceans. They are neither easily recycled nor biodegradable, and must be disposed of in landfills that are expensive to use, and rapidly being filled to capacity. These vessel sleeves can also be incinerated, but this method of disposal produces toxic fumes, and requires significant environmental safeguards.

It would be advantageous for an advertising promotion or novelty item to serve a dual role as either a vessel coaster or insulating vessel sleeve that is adjustable, inexpensive to produce, provides adequate insulation, is collapsible for storage and shipment, and which is generally friendly to the environment.

Coffin, Sr., U.S. Pat. No. 5,205,473, issued on Apr. 27, 1993, discloses a recyclable corrugated beverage container and holder. Shelby, U.S. Pat. No. 5,445,315, issued on Aug. 29, 1995, teaches an insulated beverage receptacle holder. Graham, U.S. Pat. No. 6,026,983, issued on Feb. 22, 2000, reveals a combination beverage sleeve and coaster. Ward, U.S. Pat. No. 6,273,333, issued on Aug. 14, 2001, discloses a combination coaster and cup holder. Shikaya, U.S. Pat. No. 3,908,523, issued on Sep. 30, 1975, reveals a method of making a liquid-tight cup.

It is thus an object of the present invention to provide a drinking vessel sleeve which is adjustable in diameter to snugly receive vessels of at least two different diameters, such as to fit beer bottles and also to fit soft drink bottles and beer cans.

It is another object of the present invention to provide such a drinking vessel sleeve which is readily convertible into a flat configuration for use as a coaster and also for compact storage, and which presents exposed surfaces suitable for displaying advertising indicia such as beverage company logos.

It is still another object of the present invention to provide such a drinking vessel sleeve which eliminates the condensation that forms on the outside of cold beverage vessels and makes them slippery to hold and to provide a coaster which protects surfaces on which beverage vessels are placed.

It is finally an object of the present invention to provide such a drinking vessel sleeve which is durable, reliable and formed of materials which are relatively inexpensive, biodegradable, easily recycled and disposable.

SUMMARY OF THE INVENTION

The present invention accomplishes the above-stated objectives, as well as others, as may be determined by a fair reading and interpretation of the entire specification.

An adjustable diameter drinking vessel sleeve is provided, including a sleeve side wall sheet having a first side wall sheet end and a second side wall sheet end and being coiled into a tubular sleeve configuration having a sleeve circumference, so that the first side wall sheet end is radially spaced inwardly from the second side wall sheet end, and including an adjustment lever structure pivotally interconnecting the first and second side wall sheet ends and extending radially inwardly from the first side wall sheet end to define a lever tab portion; so that pivoting the lever tab portion toward the first side wall sheet end circumferentially spaces the first side wall sheet end and the second side wall sheet end apart from each other to increase the sleeve circumference and thereby to place the sleeve in a larger diameter mode to receive a larger diameter drinking vessel, and so that pivoting the lever structure toward the second side wall causes the second side wall end to overlap the first side wall end to decrease the sleeve circumference and thereby place the sleeve in a smaller diameter mode to receive a smaller diameter drinking vessel.

The sleeve in its larger diameter mode preferably is sized in diameter to snugly receive a standard sized beverage can and in its smaller diameter mode is sized in diameter to snugly receive a standard sized beer bottle. The adjustment lever structure preferably includes first and second side wall end segments of the first and second side wall ends bent radially inward from first and second bend lines, the side wall end segments being joined face to face in a radially offset relationship so that the first side wall end is positioned radially inward relative to the second side wall end, where the first and second side wall end segments pivot relative to the remainder of the sleeve substantially at the first and second bend lines.

The sleeve preferably includes diametrically opposed longitudinal or axial folds so that the empty sleeve can be folded flat and function as a coaster. One of the folds preferably is defined by the lever structure and the opposing fold is defined by a longitudinal groove in the sleeve side wall.

The adjustable diameter drinking vessel sleeve preferably additionally includes advertising indicia on opposing faces of the sleeve when the sleeve is in the coaster mode. The sleeve preferably is formed at least in part of insulating material to shield a user hand from extreme beverage temperatures. The insulating material preferably includes corrugated cardboard. The first side wall sheet end and the second side wall sheet end preferably have sheet end corners, and the sheet end corners preferably are rounded.

An apparatus is further provided, including a larger diameter drinking vessel; and a sleeve side wall sheet having a first side wall sheet end and a second side wall sheet end and being coiled into a tubular sleeve configuration having a sleeve circumference, the first side wall sheet end being radially spaced inwardly from the second side wall sheet end, and including an adjustment lever structure pivotally interconnecting the first and second side wall sheet ends and extending radially inwardly from the first side wall sheet end to define a lever tab portion; the lever tab portion being pivoted toward the first side wall sheet end to circumferentially space the first side wall sheet end and the second side wall sheet end apart from each other so that the sleeve is in a larger diameter mode, the sleeve encircling the larger diameter drinking vessel, the larger diameter drinking vessel bearing against the lever tab portion and thereby obstructing the lever tab portion against pivoting.

An apparatus is still further provided, including a smaller diameter drinking vessel; and a sleeve side wall sheet having a first side wall sheet end and a second side wall sheet end and being coiled into a tubular sleeve configuration having a sleeve circumference, the first side wall sheet end being radially spaced-inwardly from the second side wall sheet end, and including an adjustment lever structure pivotally interconnecting the first and second side wall sheet ends and extending radially inwardly from the first side wall sheet end to define a lever tab portion; the lever tab portion being pivoted toward the second side wall sheet end so that the second side wall end overlaps the first side wall end so that the sleeve is in a smaller diameter mode, the sleeve encircling the smaller diameter drinking vessel, the smaller diameter drinking vessel bearing against the lever tab portion and thereby obstructing the lever tab portion against pivoting, thereby retaining the sleeve in the smaller diameter mode.

BRIEF DESCRIPTION OF THE DRAWINGS

Various other objects, advantages, and features of the invention will become apparent to those skilled in the art from the following discussion taken in conjunction with the following drawings, in which:

FIGS. 6 and 6*a* are enlarged partial views of preferred fluting structures, in which FIG. 6 illustrates a sinuous fluting adhered to an inner and outer liner, and FIG. 6*a* illustrates a sinuous fluting adhered to a single liner.

DETAILED DESCRIPTION OF THE PREFERRED EMBODIMENTS

Figure 1:
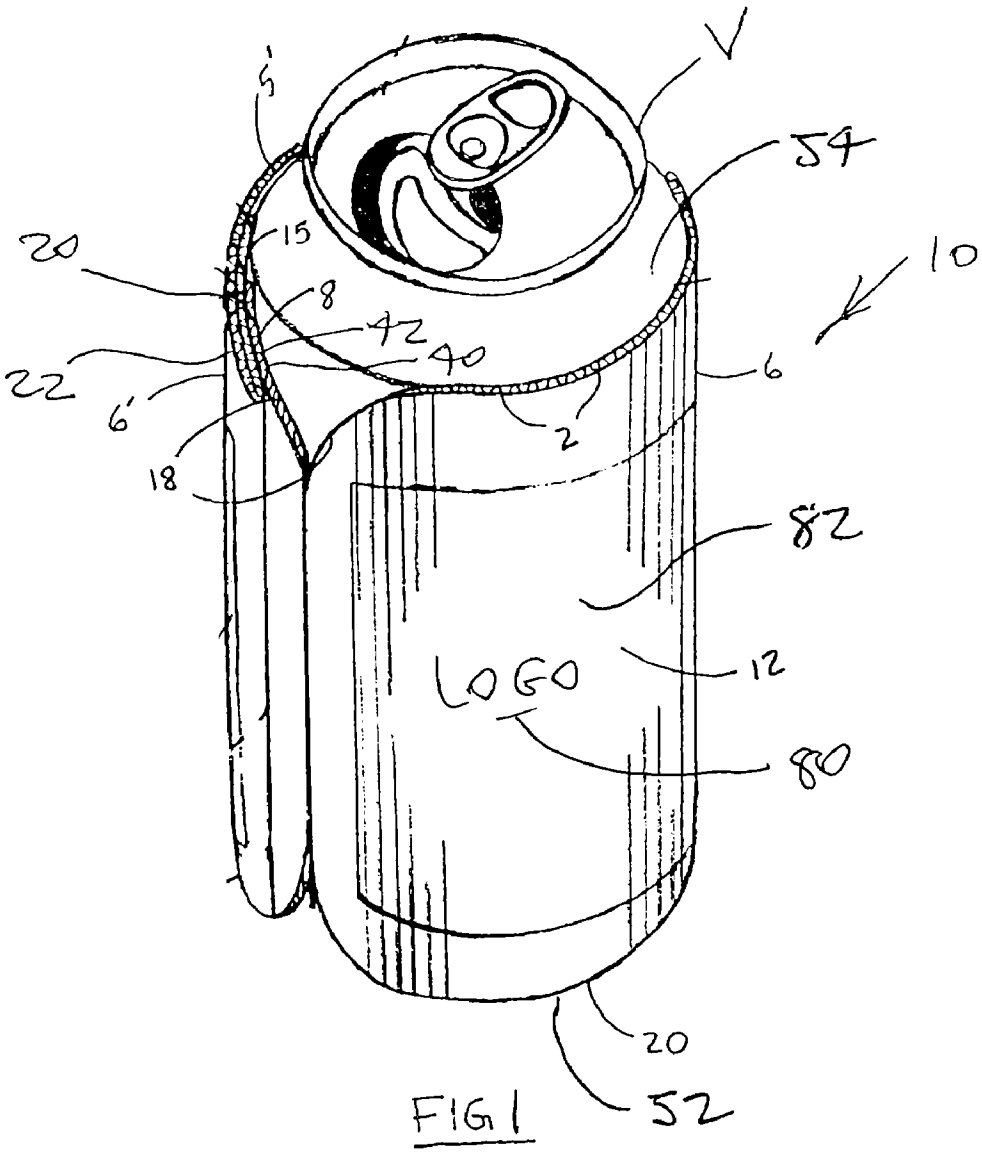
FIG. 1 is a perspective view of the insulating vessel sleeve of this invention holding a beverage vessel with advertising indicia on both sides.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is: now made to the drawings, wherein like characteristics and features of the present invention shown in the various FIGURES are designated by the same reference numerals.

First Preferred Embodiment

Referring to FIGS. 1–8, an adjustable diameter drinking vessel sleeve 10 is disclosed including a sleeve side wall sheet 12 having a first side wall sheet end 20 and a second side wall sheet end 40 and being coiled into a tubular configuration so that the first side wall sheet end 20 is radially spaced inwardly from the second side wall sheet end 40, and including a substantially rigid or resilient adjustment lever structure 60 pivotally interconnecting the first and second side wall sheet ends 20 and 40, respectively, and extending radially inwardly from the first side wall sheet end 20 to define a lever tab portion 62. As a result, pivoting the lever structure 60 toward the first side wall sheet end 20 circumferentially spaces the first and second side wall sheet ends 20 and 40 apart from each other to place the sleeve 10 in a larger diameter mode to receive larger diameter drinking vessels V, and pivoting the lever structure 60 toward the second side wall end 40 causes the second side wall to overlap the first side wall end 20 and thereby place sleeve 10 in a smaller diameter mode to receive smaller diameter drinking vessels V. A vessel V within sleeve 10 laterally abuts the tab portion 62 and thereby retains tab portion 62 in either pivoted position, in turn retaining the sleeve 10 in its given diameter mode. The sleeve 10 in its larger diameter mode preferably is sized in diameter to snugly receive a standard sized beer can or soft drink bottle and in its smaller diameter mode is sized in diameter to snugly receive, a standard sized beer bottle.

The adjustment lever structure 60 preferably is formed by bending first and second side wall end segments 22 and 42 of the first and second side wall ends radially inward from first and second fold lines C and B, respectively. The side wall end segments 20 and 40 are adhesively joined face to face in a radially offset relationship so that the first side wall end 20 is positioned and spaced radially inward relative to the second side wall end 20. See FIG. 4. The first and second side wall end segments 22 and 42 pivot relative to the remainder of the sleeve 10 at first and second fold lines C and B, respectively.

The sleeve 10 preferably has three diametrically opposed longitudinal or axial fold lines A, B and C so that the empty sleeve 10 can be folded flat and function as a coaster. See FIG. 2. One of the fold lines B or C may be defined by the lever structure 60 and the opposing fold line A may be defined by a longitudinal groove or score in the inward face of the sleeve 10 side wall, and preferably all three fold lines A, B and C are scored. Advertising indicia 80 preferably are printed or embossed onto opposing outward faces 82 of the sleeve 10 when in the coaster mode. Corners defined by first and second side wall sheet ends 20 and 40 preferably are rounded.

The sleeve 10 preferably provides a combination adjustable diameter vessel sleeve and beverage coaster formed of materials which are thermally insulating and environmentally friendly. The sleeve side wall sheet 12 preferably is corrugated to contain longitudinally extending flutes. The corrugated side wall sheet 12 preferably is formed of celluloid materials such as craft paper, sulfide paper, recycled paper, or any other paper currently used in the corrugated box making industry. The fluting and liners of the invention are adhered to one another with an adhesive.

Figure 4:
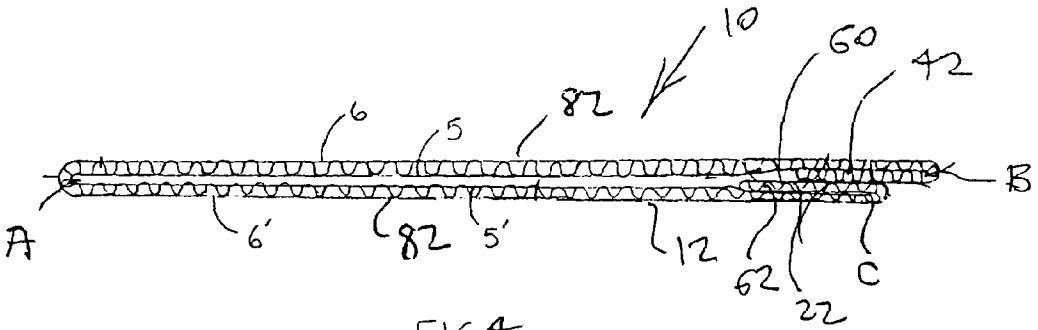
FIG. 4 is a cross-sectional view of the coaster in a collapsed and flattened state and constructed in accordance with the invention.
Figure 3:
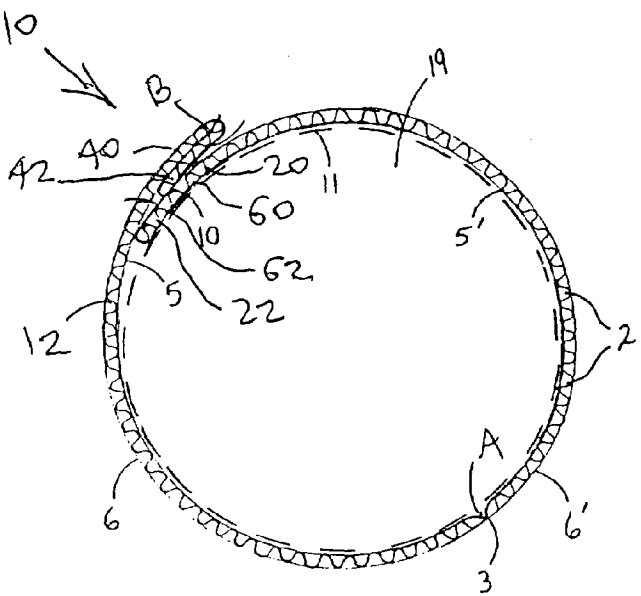
FIG. 3 is a top view of the preferred embodiment in its closed mode.
Figure 2:
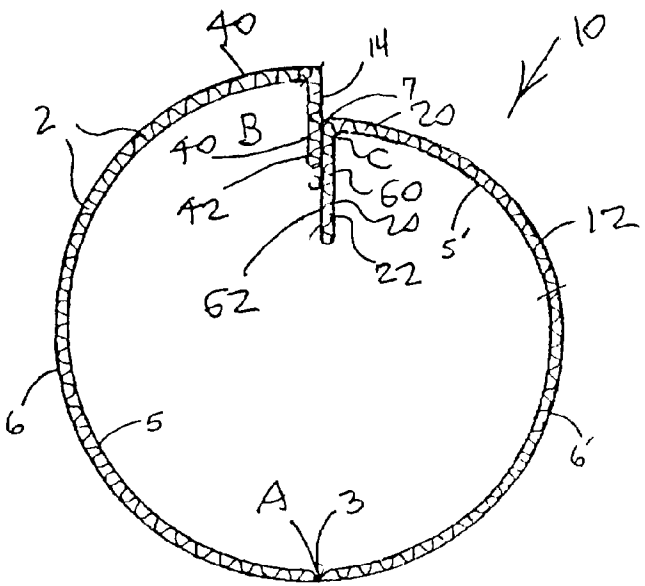
FIG. 2 is a top view of the preferred embodiment expanded from the coaster mode to the sleeve mode, the lever tab portion being in its neutral position between being pivoted against the first or the second side wall sheet end.
Figure 5:
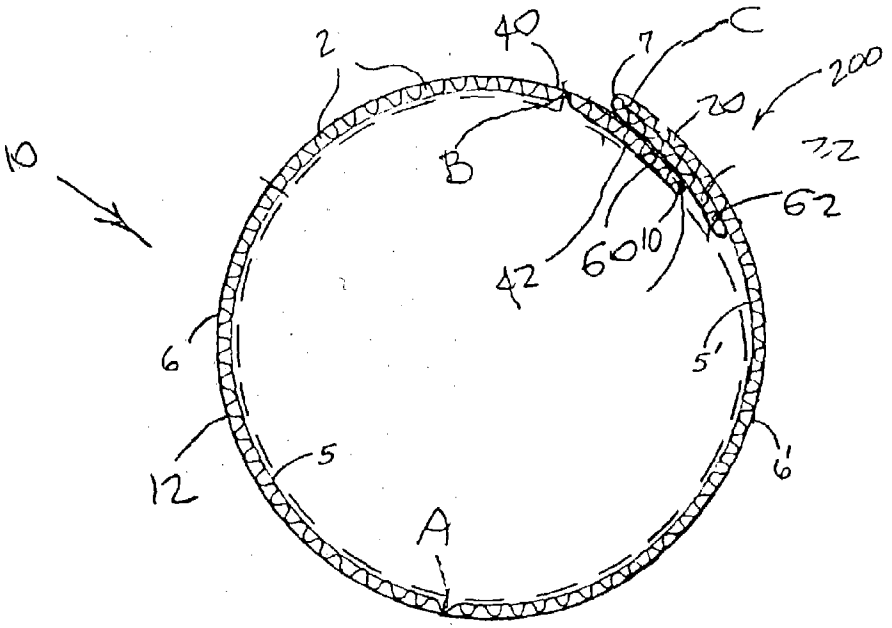
FIG. 5 is a top view of the preferred embodiment in its open mode.
Figure 7:
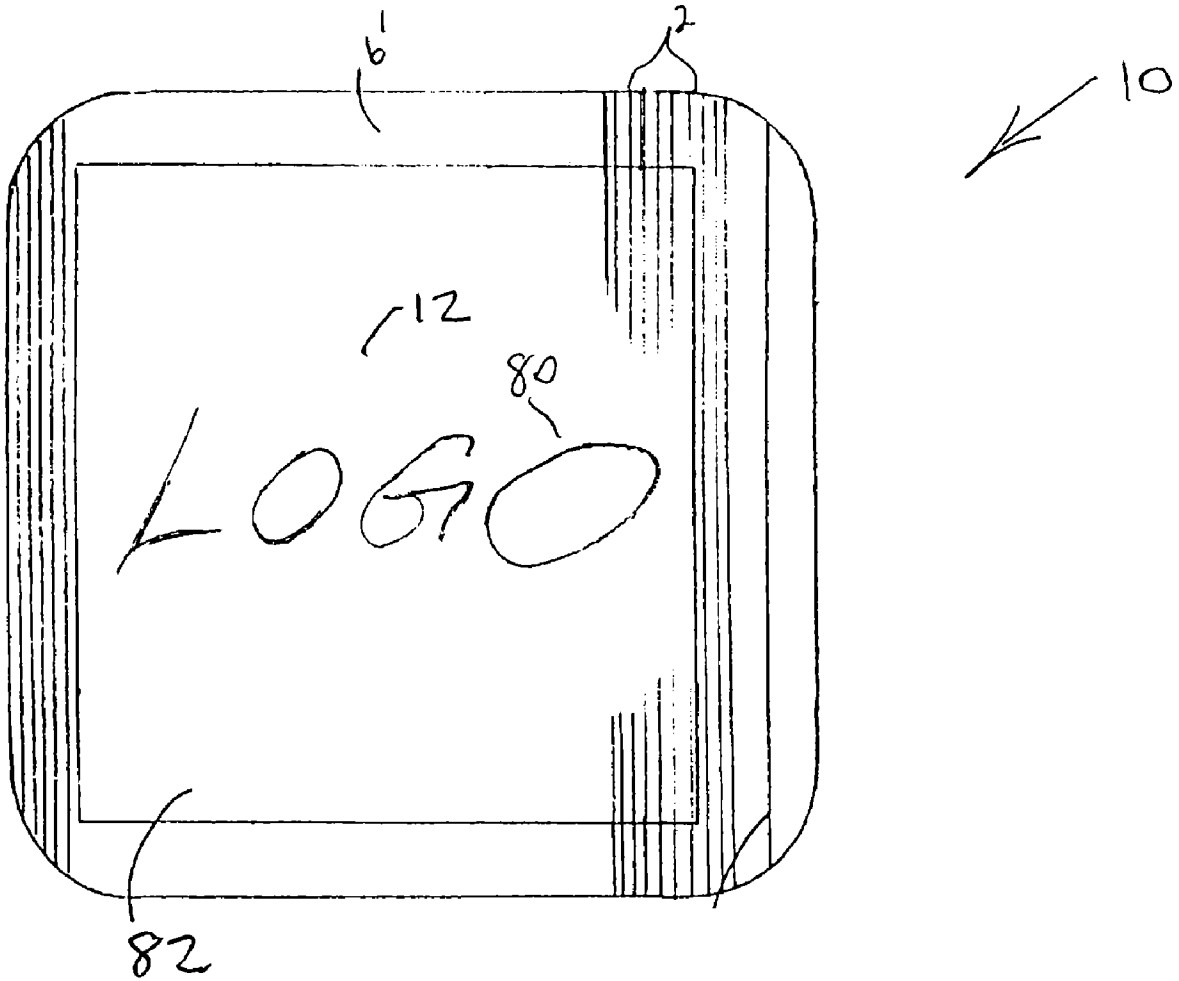
FIG. 7 is a side view of the bottom of the coaster in a substantially collapsed and flattened state and constructed in accordance with the invention.
Figure 8:
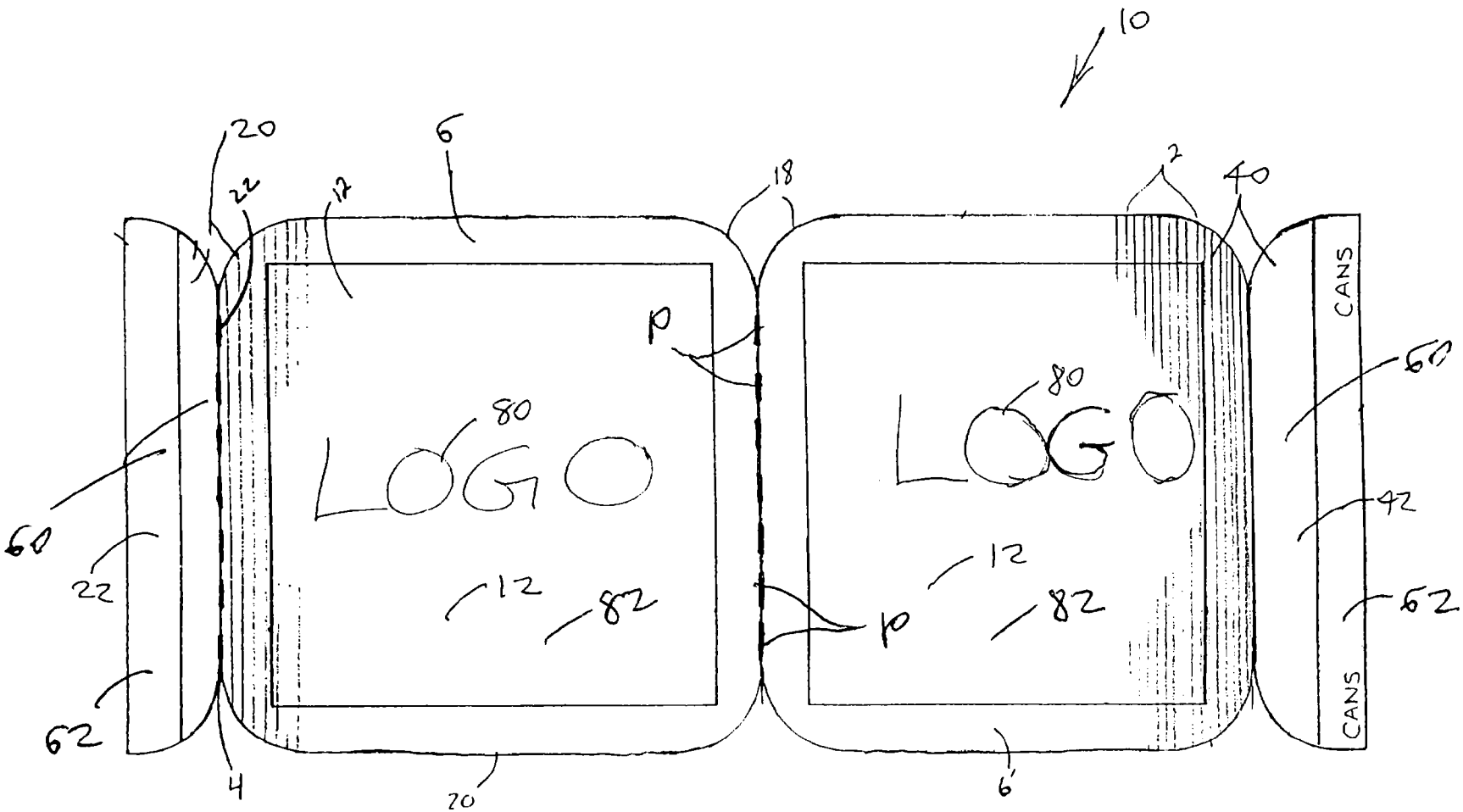
FIG. 8 is a side view of a corrugated sheet used in the construction of the collapsible insulated vessel sleeve and coaster of the invention.

With reference to FIGS. 4, 7 and 8, there is shown in multiple views the preferred embodiment of sleeve 10 folded in the flat, coaster mode. A sheet of corrugated paper is printed, scored, and/or perforated, and die cut into the approximate shape depicted in the appended FIGURES. FIGS. 4 and 7 show the sleeve 10 folded for use as a coaster on table and counter tops or other flat planar surfaces where beverage condensation and spills may damage the surface on which the beverage rests. In the preferred embodiment, sleeve 10 is constructed of liquid absorbing corrugated paper. Corrugated sinuous flutes 14 run longitudinally between the lower sleeve end opening 52 and upper sleeve end opening 54 and are sandwiched between outer liner halves 6 and 6' and inner liner halves 5 and 5'. Inner liner halves 5 and 5' are preferably coated with a water resistant agent for minimizing the absorption of condensation and other liquids into the celluloid material, increasing the sleeve 10 durability. The sheet 12 of corrugated paper preferably is scored and folded at folding lines A, B and C. This construction produces outer liner halves 6 and 6', and inner liner halves 5 and 5' and end segments. Outer liner half 6 forms the top of the coaster formed by folding sleeve 10 flat and outer liner half 6' forms the bottom half of the coaster. Folding lines A, B and C optionally each include a line of perforations P to permit greater ease in sleeve 10 folding.

Alternative corrugated structure shapes are contemplated including circular, triangular, square, or rectangular fluting, all of which contain insulating air. This fluting may be sealed at one or both ends to provide more containment of air, or left open to permit the air to flow through the fluting as it is heated or cooled by the contents of the beverage vessel V. In the preferred embodiment, the corrugated fluting runs parallel to the folding lines A, B and C and their score lines, but it is also contemplated that the flutes may run horizontal to, or at an oblique angle to the folding lines A, B and C and their score lines. Finally, the cross-sectional shape of the corrugated sleeve 10 perimeter of this invention may be circular, square, rectangular, oval or any other desirable shape.

Figure 6A:
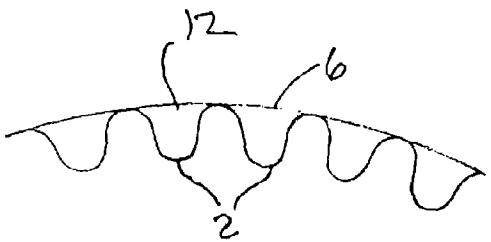
Figure 6:
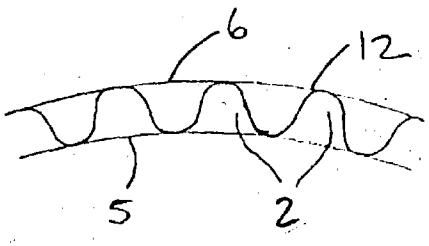

A single faced corrugation, such as that described in FIG. 6*a* may also be used, however, this configuration is not as durable as the double faced corrugation depicted in FIG. 6. If a single faced corrugation were employed, inner liner 5 and 5' could be eliminated and a water repellent coating preferably applied to the exposed corrugated flutes. The corrugated sheet 12 is thereafter scored and/or perforated, cut and adhesively joined to provide a similar construction as described above for the double-faced sheet 12.

The airspace created by the corrugated flute and liner combinations described above is an important element for constructing the coaster and beverage sleeve of this invention. The air contained within the corrugated flutes is a very effective insulator and keeps beverages hot or cold for extended periods.

From the foregoing, it can be realized that this invention provides improved means for making promotional and advertising mediums that serve dual roles as adjustable insulation sleeves for retaining vessels V containing hot or cold liquids beverage and as coasters. Inventive sleeve 10 is both inexpensive to manufacture and relatively safe for the environment. The corrugated beverage coaster and insulated beverage sleeve 10 of this invention are readily fabricated with existing paper manufacturing equipment, and present an adequate solution to the waste disposal problems associated with polystyrene, foam and other synthetic compounds.

Unlike beverage vessel sleeves of the prior art, the present sleeve 10 is open at both ends to define lower and upper sleeve end openings 52 and 54, respectively, so that a vessel can be inserted into the sleeve 10 from either the top or the bottom. The word "cans" or an image of a can preferably is printed on the side of the lever tab portion 62 which would abut a can placed within the sleeve 10, to indicate which way the lever tab portion 62 is to be pivoted for insertion of a can as opposed to a beer bottle. See FIG. 8. By the same token, the word "bottle" or an image of a beverage bottle optionally is printed on the other side of the lever tab portion 62. Finally, the preferred opposing rounded corners of the coaster faces 82 formed into the sleeve side wall sheet 12 at the fold lines A and B not only serve to make the coaster mode more attractive but also expose a portion of the side of a can when the invention is in the sleeve 10 mode for smooth and unobstructed pouring and to permit user lip contact with the can V side wall.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An adjustable diameter drinking vessel sleeve, comprising:

a sleeve side wall sheet having a first side wall sheet end and a second side wall sheet end and being coiled into a tubular sleeve configuration having a sleeve circumference, such that said first side wall sheet end is radially spaced inwardly from said second side wall sheet end, and comprising an adjustment lever structure pivotally interconnecting said first and second side wall sheet ends and extending radially inwardly from said first side wall sheet end to define a lever tab portion;

such that pivoting said lever tab portion toward said first side wall sheet end circumferentially spaces said first side wall sheet end and said second side wall sheet end apart from each other to increase the sleeve circumference and thereby to place said sleeve in a larger diameter mode to receive a larger diameter drinking vessel, and such that pivoting said lever structure toward said second side wall causes said second side wall end to overlap said first side wall end to decrease the sleeve circumference and thereby place said sleeve in a smaller diameter mode to receive a smaller diameter drinking vessel.

2. The adjustable diameter drinking vessel sleeve of claim 1, wherein said sleeve in its larger diameter mode is sized in diameter to snugly receive a standard sized beverage can and in its smaller diameter mode is sized in diameter to snugly receive a standard sized beer bottle.

3. The adjustable diameter drinking vessel sleeve of claim 1, wherein said adjustment lever structure comprises first and second side wall end segments of the first and second side wall ends bent radially inward from first and second bend lines, said side wall end segments being joined face to face in a radially offset relationship such that said first side wall end is positioned radially inward relative to said second side wall end, wherein said first and second side wall end segments pivot relative to the remainder of the sleeve substantially at said first and second bend lines.

4. The adjustable diameter drinking vessel sleeve of claim 1, wherein said sleeve comprises diametrically opposed longitudinal or axial folds such that the empty said sleeve can be folded flat and function as a coaster.

5. The adjustable diameter drinking vessel sleeve of claim 4, wherein one of said folds is defined by said lever structure and the opposing said fold is defined by a longitudinal groove in said sleeve side wall.

6. The adjustable diameter drinking vessel sleeve of claim 4, additionally comprising advertising indicia on opposing faces of said sleeve.

7. The adjustable diameter drinking vessel sleeve of claim 1, wherein said sleeve is formed at least in part of insulating material to shield a user hand from extreme beverage temperatures.

8. The adjustable diameter drinking vessel sleeve of claim 7, wherein said insulating material comprises corrugated cardboard.

9. The adjustable diameter drinking vessel sleeve of claim 1, wherein said first side wall sheet end and said second side wall sheet end have sheet end corners, and wherein said sheet end corners are rounded.

10. An apparatus, comprising:

a larger diameter drinking vessel;

and a sleeve side wall sheet having a first side wall sheet end and a second side wall sheet end and being coiled into a tubular sleeve configuration having a sleeve circumference, said first side wall sheet end being radially spaced inwardly from said second side wall sheet end, and comprising an adjustment lever structure pivotally interconnecting said first and second side wall sheet ends and extending radially inwardly from said first side wall sheet end to define a lever tab portion;

said lever tab portion being pivoted toward said first side wall sheet end to circumferentially space said first side wall sheet end and said second side wall sheet end apart from each other such that said sleeve is in a larger diameter mode, said sleeve encircling said larger diameter drinking vessel, said larger diameter drinking vessel bearing against said lever tab portion and thereby obstructing said lever tab portion against pivoting.

11. An apparatus, comprising:

a smaller diameter drinking vessel;

and a sleeve side wall sheet having a first side wall sheet end and a second side wall sheet end and being coiled into a tubular sleeve configuration having a sleeve circumference, said first side wall sheet end being radially spaced inwardly from said second side wall sheet end, and comprising an adjustment lever structure pivotally interconnecting said first and second side wall sheet ends and extending radially inwardly from said first side wall sheet end to define a lever tab portion;

said lever tab portion being pivoted toward said second side wall sheet end such that said second side wall end overlaps said first side wall end such that said sleeve is in a smaller diameter mode, said sleeve encircling said smaller diameter drinking vessel, said smaller diameter drinking vessel bearing against said lever tab portion and thereby obstructing said lever tab portion against pivoting, thereby retaining said sleeve in the smaller diameter mode.

* * * * *